US010469938B2

(12) United States Patent
Ralph

(10) Patent No.: US 10,469,938 B2
(45) Date of Patent: Nov. 5, 2019

(54) DIAPHRAGM PORTED TWEETER

(71) Applicant: Alexander B. Ralph, Winter Garden, FL (US)

(72) Inventor: Alexander B. Ralph, Winter Garden, FL (US)

( * ) Notice: Subject to any disclaimer, the term of this patent is extended or adjusted under 35 U.S.C. 154(b) by 0 days.

(21) Appl. No.: 16/225,312

(22) Filed: Dec. 19, 2018

(65) Prior Publication Data

US 2019/0253787 A1 Aug. 15, 2019

Related U.S. Application Data

(60) Provisional application No. 62/631,066, filed on Feb. 15, 2018.

(51) Int. Cl.

| | |
|---|---|
| ***H04R 1/00*** | (2006.01) |
| ***H04R 1/24*** | (2006.01) |
| ***H04R 1/28*** | (2006.01) |
| ***H04R 9/02*** | (2006.01) |
| ***H04R 9/06*** | (2006.01) |
| ***H04R 7/06*** | (2006.01) |

(52) U.S. Cl.

CPC ..... *H04R 1/24* (2013.01); *H04R 1/2811* (2013.01); *H04R 7/06* (2013.01); *H04R 9/025* (2013.01); *H04R 9/066* (2013.01)

(58) Field of Classification Search

CPC . H04R 7/00; H04R 7/12; H04R 7/122; H04R 7/127; H04R 7/16; H04R 7/18

USPC ..... 381/398, 430

See application file for complete search history.

(56) References Cited

U.S. PATENT DOCUMENTS

| | | | | |
|---|---|---|---|---|
| 4,351,412 | A * | 9/1982 | Yamamuro | G10K 13/00 181/170 |
| 4,817,165 | A * | 3/1989 | Amalaha | H04R 7/122 181/170 |
| 5,721,786 | A | 2/1998 | Carrington | |
| 6,457,548 | B1 | 10/2002 | D'Hoogh | |
| 7,463,744 | B2 | 12/2008 | Parker et al. | |
| 9,654,879 | B2 | 5/2017 | Jensen | |
| 2001/0043714 | A1* | 11/2001 | Asada | H04R 5/02 381/399 |
| 2005/0117772 | A1 | 6/2005 | Chang | |
| 2006/0078153 | A1 | 4/2006 | Sato | |
| 2006/0182302 | A1 | 8/2006 | Onodera | |
| 2009/0304225 | A1 | 12/2009 | Kamimura et al. | |
| 2012/0281861 | A1 | 11/2012 | Lin | |
| 2015/0117698 | A1 | 4/2015 | Bullimore | |
| 2016/0127823 | A1 | 5/2016 | Huang et al. | |
| 2016/0165335 | A1 | 6/2016 | Goossens | |
| 2016/0173972 | A1 | 6/2016 | Moro | |
| 2017/0171663 | A1 | 6/2017 | Calmel et al. | |

* cited by examiner

*Primary Examiner* — Katherine A Faley
(74) *Attorney, Agent, or Firm* — Matthew G. McKinney, Esq.; Allen, Dyer et al.

(57) ABSTRACT

A diaphragm ported tweeter includes a ring structure having an upper portion and a lower portion, and a dome-shaped diaphragm having a periphery secured to the upper portion of the ring structure and a concentrically positioned aperture at an apex of the dome-shaped diaphragm. The diaphragm ported tweeter also includes an acoustic duct having an open first end coupled to the aperture and a second open end extending away from the aperture. The diaphragm ported tweeter is configured as a Helmholtz resonator to increase an output level over a range of frequencies.

20 Claims, 8 Drawing Sheets

DIAPHRAGM PORTED TWEETER

CROSS-REFERENCE TO RELATED APPLICATIONS

This application claims priority to U.S. Provisional Application Ser. No. 62/631,066 filed on Feb. 15, 2018 the contents of which are herein incorporated by reference in their entirety.

TECHNICAL FIELD

The present disclosure relates to the field of sound producing devices, and more particularly to a diaphragm ported tweeter.

BACKGROUND

Tweeters are a type of speaker that is designed to reproduce higher audio frequencies typically from as low as 1.5 kHz to 20 kHz or higher. As is known to those of skill in the art, the volume of air behind a tweeter diaphragm helps determine the frequency and Q factor at resonance, as the air acts as a spring against the diaphragm. For this reason, the volume of air behind the diaphragm of a traditional tweeter is sealed, to prevent the air from escaping during operation and deteriorating the sound quality of the speaker.

Although this arrangement has functioned well for many years, the small shape and size of tweeters have made it difficult for them to reproduce frequencies below around 3000 Hz at a high output level without excessive distortion or thermal overload. For example, a 25 mm diaphragm on a sealed tweeter would need to oscillate a distance of 0.24 mm in order to produce 100 dB SPL at 1 meter at 3000 Hz, but would need to increase this travel 4 fold to 0.96 mm at 1500 Hz.

Most tweeters of this design use an underhung voice coil design in order to maximize efficiency, and will start to produce excessive distortion once exceeding around 0.2 mm travel, a travel distance that can be maintained by use of a tuned port. Due to this limitation, many commercial speaker systems employ a bass/midrange driver or a dedicated midrange driver to cover the frequencies up to 3000 Hz or higher. Unfortunately, there are a lot of compromises with this approach such as cone breakup and reduced high frequency dispersion of the bass/midrange driver or a more complex and expensive crossover and box and the reduced efficiency of most dedicated midrange drivers.

SUMMARY

A diaphragm ported tweeter is disclosed. The diaphragm ported tweeter includes a ring structure having an upper portion and a lower portion, and a dome-shaped diaphragm having a periphery secured to the upper portion of the ring structure and a concentrically positioned aperture at an apex of the dome-shaped diaphragm. The diaphragm ported tweeter also includes an acoustic duct having an open first end coupled to the aperture and a second open end extending away from the aperture. The diaphragm ported tweeter is configured as a Helmholtz resonator to increase an output level over a range of frequencies.

The dome-shaped diaphragm may comprise a woven fabric, thin metal or other such material. Further, the acoustic duct may be orientated perpendicular to the periphery of the ring structure. In addition, a cavity may be formed under the dome-shaped diaphragm. The acoustic duct is configured to connect ambient air to the cavity and is configured for a mass of air within the acoustic duct to oscillate with movement of the dome-shaped diaphragm over a range of frequencies.

The diaphragm ported tweeter may also include a magnetic assembly secured to the lower portion of the ring structure. The acoustic duct may include a support member having a base and a plurality of elongated arms, with each elongated arm having a first end secured to the base and a second end extending upwards to an outer surface of the acoustic duct to suspend the acoustic duct. A gasket seals a perimeter of the first open end of the acoustic duct to the dome-shaped diaphragm. The acoustic duct is sized and shaped to tune the cavity of air behind the dome-shaped diaphragm to a desired particular frequency.

The diaphragm ported tweeter may include a voice coil secured to the diaphragm concentrically secured within the ring structure, and the support member is mounted to the magnetic assembly and positioned within the cavity behind the dome-shaped diaphragm.

In another particular aspect, a method of making a diaphragm ported tweeter includes providing a ring structure having an upper portion and a lower portion, and securing a periphery of a dome-shaped diaphragm to the upper portion of the ring structure. The dome-shaped diaphragm has a concentrically positioned aperture at an apex of the dome-shaped diaphragm.

The method also includes mounting an open first end of an acoustic duct to the aperture and a second open end of the acoustic duct extending away from the aperture. The diaphragm ported tweeter is configured as a Helmholtz resonator to increase an output level over a range of frequencies. The method may also include securing a voice coil and a magnetic assembly concentrically within the ring structure.

DETAILED DESCRIPTION

The present disclosure will now be described more fully hereinafter with reference to the accompanying drawings, in which several embodiments of the invention are shown. This present disclosure may, however, be embodied in many different forms and should not be construed as limited to the embodiments set forth herein. Rather, these embodiments are provided so that this disclosure will be thorough and complete, and will fully convey the scope of the present disclosure to those skilled in the art. Like numbers refer to like elements throughout.

Figure 1:
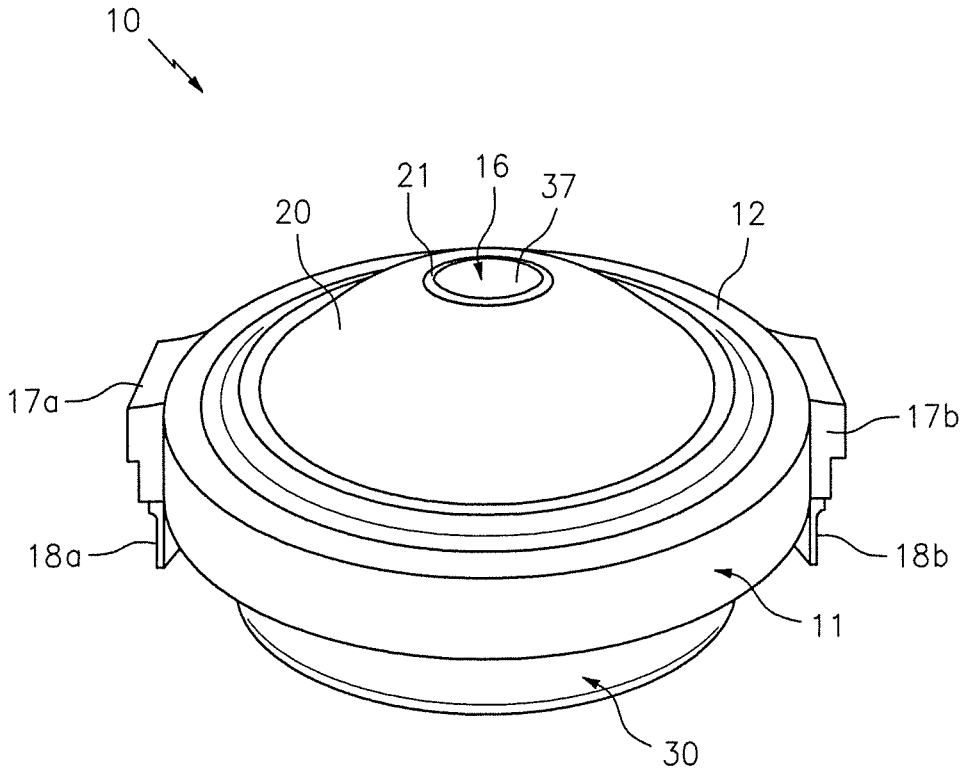
FIG. 1 is a perspective view of a diaphragm ported tweeter in accordance with the present disclosure.

Referring initially to FIG. 1, a schematic of a tweeter 10 in accordance with an aspect of the invention is illustrated. As explained in more detail below, the tweeter 10 is configured to connect a cavity of air behind a diaphragm 20 to the outside air through an acoustic duct 37 that passes through the diaphragm 20.

Accordingly, this novel configuration allows a mass of air within the acoustic duct 37 to oscillate with the movement of the diaphragm 20 over a range of frequencies. As a result of the proximity of a first sound wave emitted from the acoustic duct 37 and a second sound wave emitted from the diaphragm 20, the first and second sound waves interfere constructively over an octave or more.

The tweeter 10 serves as a Helmholtz resonator in order to increase an output level over a range of frequencies, and widens a useable frequency range when compared to a traditional sealed tweeter having the same shape and size. More specifically, the pressure waves produced by the oscillation of the air mass in the acoustic duct 37 serve to dampen the movement of the diaphragm 20 causing the diaphragm 20 to move less over the tuned range of frequencies, which reduces the distortion of the tweeter 10 over this range.

Still referring to FIG. 1, the tweeter 10 includes a ring structure 11 that is constructed from plastic, or other non-magnetic material. The ring structure 11 includes a pair of passages 17*a*, 17*b*, each on an opposing side of the ring structure 11 through which respective speaker terminals 18*a*, 18*b* can extend. The ring structure 11 has a shape and size that is complementary to the shape and size of a magnetic assembly 30 so as to be secured thereto.

Figure 2:
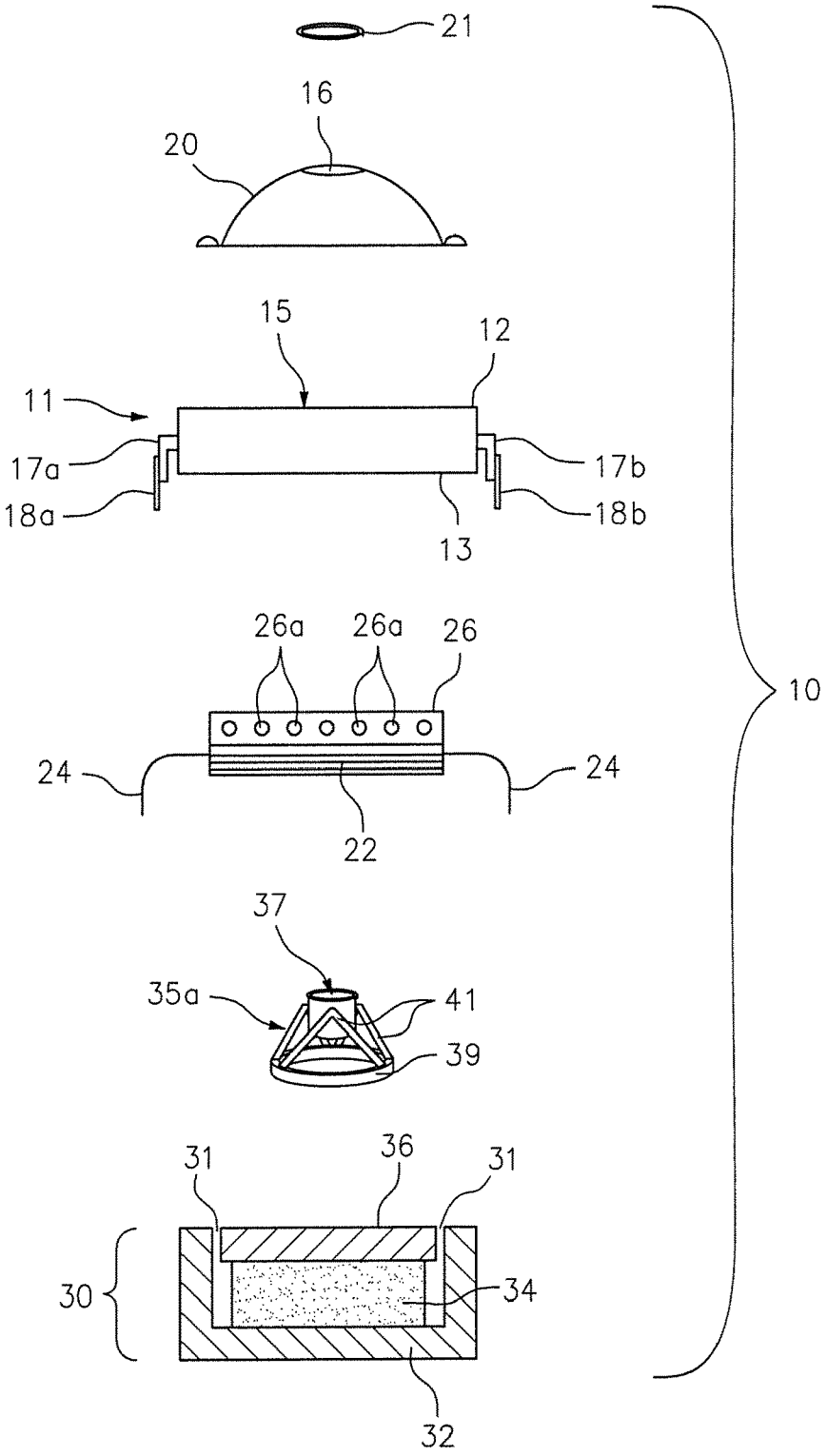
FIG. 2 is an exploded parts view of the diaphragm ported tweeter of FIG. 1, in accordance with one aspect of the invention.

Referring now to FIG. 2 that illustrates an exploded schematic view of the tweeter 10, the tweeter 10 includes the diaphragm 20 with suspension, which is dome-shaped and may comprise a woven fabric, thin metal or other such material. The diaphragm 20 includes a concentric positioned aperture 16 at an apex of the diaphragm 20. The aperture 16 leads into a first open end of the acoustic duct 37. As explained above, the acoustic duct 37 is configured to tune the cavity of air behind the diaphragm 20 to the chosen frequency. A perimeter of an upper open end of the acoustic duct 37 may be sealed to the diaphragm 20 with a flexible gasket 21.

In a particular aspect, the tweeter 10 includes a voice coil 22 having a pair of leads 24 extending therefrom. The voice coil 22 comprises a thin piece of electrically conductive wire with an insulating coating that is wrapped around a ring shaped voice coil former 26. The voice coil former 26 may include a plurality of holes 26*a* within a sidewall and comprise a low magnetic permeability material such as aluminum, polyimide, or stainless steel, for example. The voice coil 22 is secured to the diaphragm concentrically secured within the ring structure 11.

The tweeter 10 also includes a support member 35*a* that comprises a lightweight non-magnetic material such as plastic, for example. The support member 35*a* include a base 39 and a plurality of elongated arms 41, where each elongated arm 41 has a first end secured to the base 39, and a second end extending upwards to an outer surface the acoustic duct 37, where the plurality of elongated arms 41 suspend the acoustic duct 37.

The tweeter 10 also includes a magnet assembly 30 having a bottom yoke 32 that comprises a high magnetic permeability material, a high energy magnet 34 such as a neodymium or a ferrite magnet, for example, and a top plate 36 which also comprises a high magnetic permeability material. The support member 35*a* can be mounted on the top plate 36, inside the diaphragm 20 and is configured to hold rigid the acoustic duct 37 that is configured to tune the air cavity behind the diaphragm 20.

Figure 6:
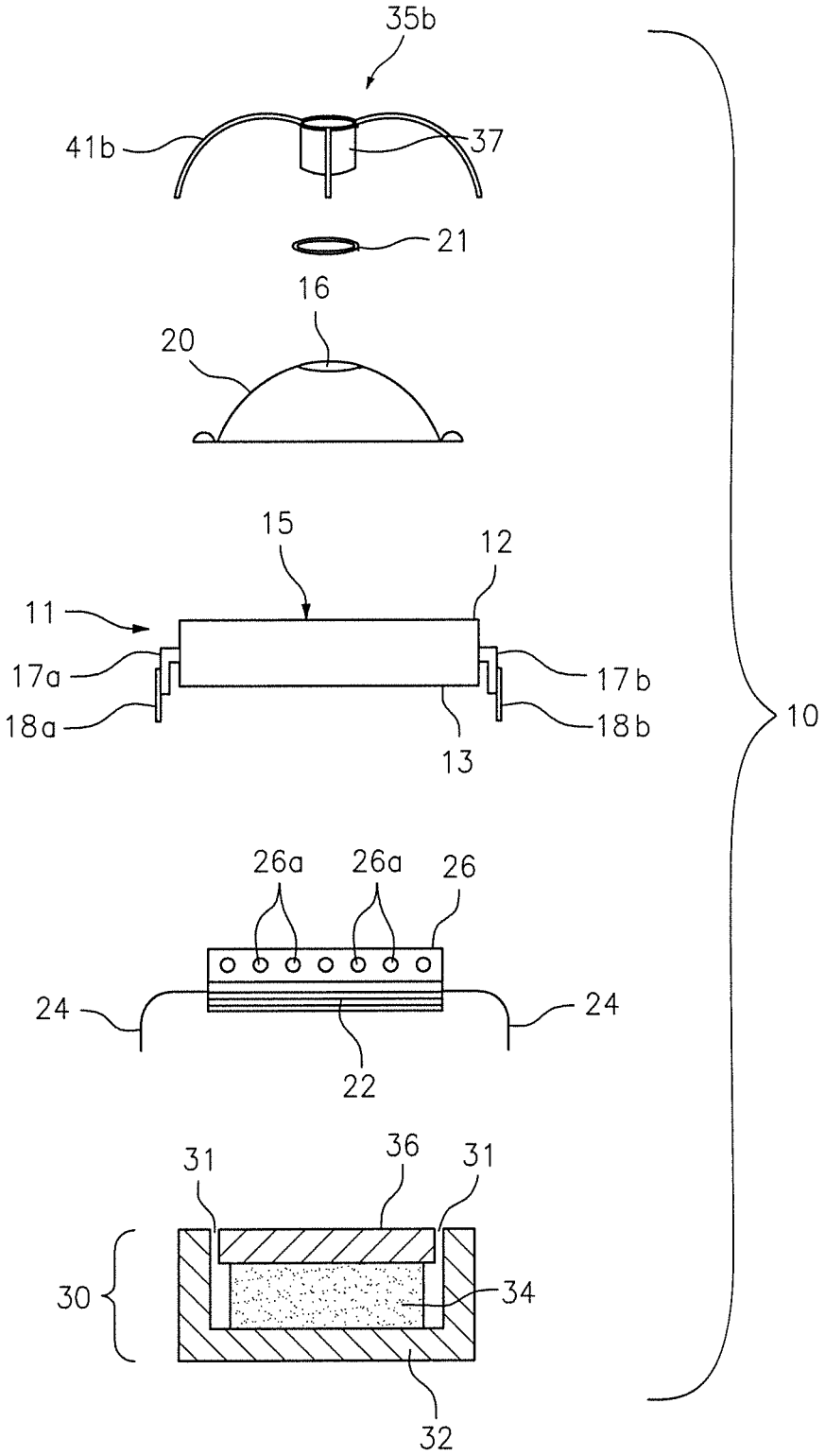
FIG. 6 is an exploded parts view of a diaphragm ported tweeter in accordance with the present disclosure with an acoustic duct supported externally by a ring structure.

Alternatively, the support member 35*a* can be positioned outside of the diaphragm 20 as shown in FIG. 6 and discussed in more detail below. The support member 35*a* may be mounted on any number of surfaces including, but not limited to, the ring structure 11, a tweeter mounting plate, a waveguide, a phase aligning lens, a protective grill or speaker box. Of course, the support member 35*a* can include any number of other shapes sizes and construction materials.

Figure 3B:
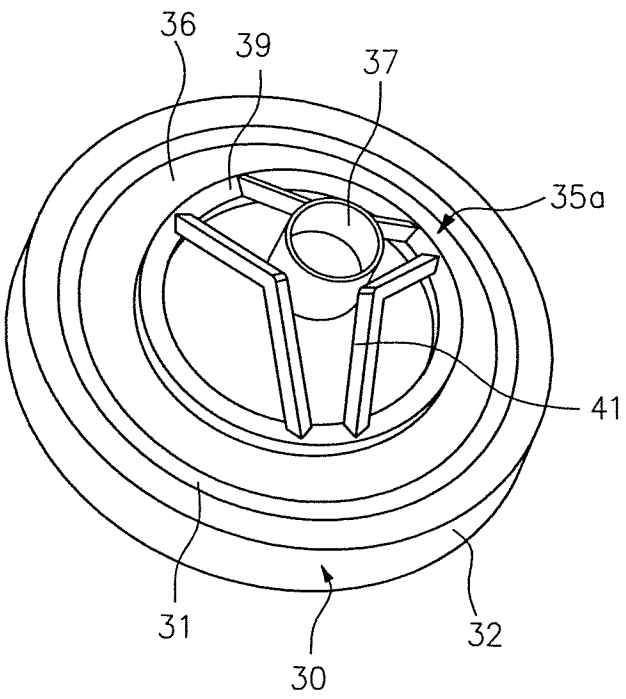
FIG. 3B is a perspective view of a bottom half of the diaphragm ported tweeter of FIG. 1.
Figure 3A:
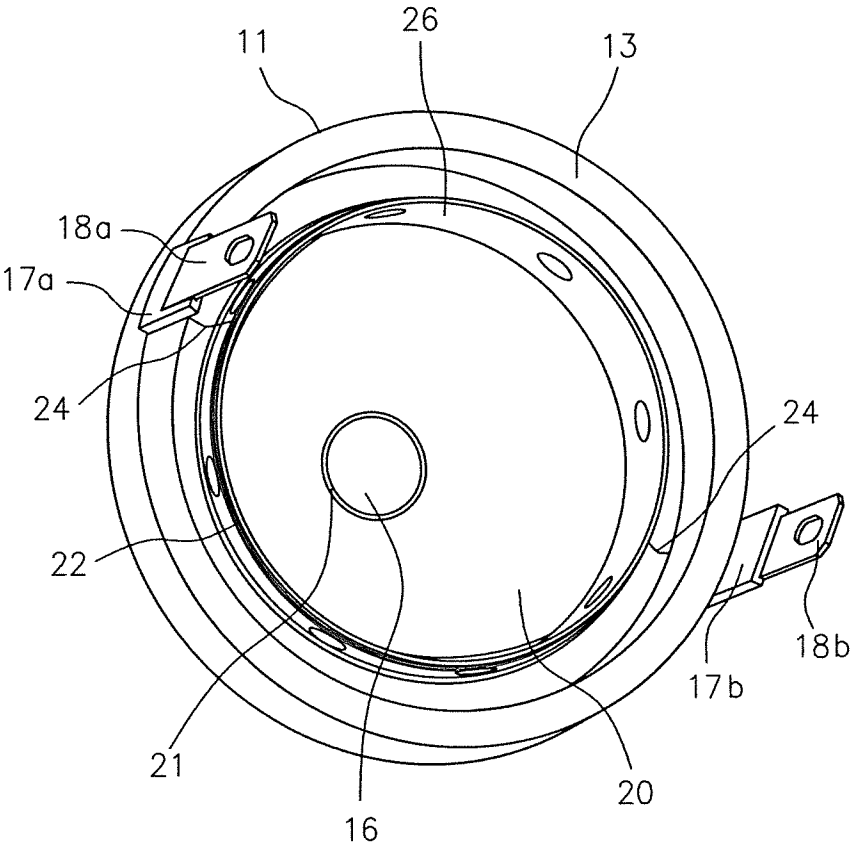
FIG. 3A is a perspective view of a top half of the diaphragm ported tweeter of FIG. 1.

FIG. 3A illustrates a bottom perspective view of a top half of the tweeter 10. As shown, the diaphragm 20, voice coil former 26 and coil 22 are positioned within the ring structure 11. Coil leads 24 from the coil 22 are routed through the passages 17*a*, 17*b* and coupled to the respective terminals 18*a*, 18*b*.

FIG. 3B illustrates a top perspective view of a bottom half of the tweeter 10. The support member 35*a* is positioned on the top plate 36 of the magnetic assembly 30. The support member 35*a* would be positioned inside a diameter formed by a voice coil gap 31 between the top plate 36 and the bottom yoke 32 when the top and bottom halves are assembled, as shown in FIG. 1. In addition, the elongated arms 41 are positioned within the voice coil former 26 and the acoustic duct 37 is sealed within the aperture 16 of the diaphragm 20 via a gasket 21.

In operation, current applied to the voice coil 22 through the terminals 18 causes the voice coil 22 to move relative to the magnet assembly 30 in a manner known in the art. The voice coil former 26 moves with the coil 22 and applies varying pressures to the diaphragm 20 to produce the desired audio output. During this time and over a range of frequencies, the mass of air within the acoustic duct 37 oscillates, due to the compressibility of the cavity of air behind the diaphragm 20. At lower frequencies the duct output is out of phase with the diaphragm 20. As the frequency rises the duct output is delayed, and becomes in phase with the diaphragm 20 at the tuning frequency.

In a particular aspect of the invention, providing the single aperture 16 at a front center portion of the diaphragm 20 reduces distortion of the diaphragm 20 and allows the diaphragm 20 to move in a pure linear motion. Stated differently, with the acoustic duct 37 located centrally to the diaphragm 20, the change in air pressure behind the diaphragm 20 caused by the air in the acoustic duct 37 oscillating back and forth is applied equally to a surface of the diaphragm 20, thereby removing any rocking motion, and potential buckling in the diaphragm 20, and the inherent distortion that would otherwise occur with a duct that was offset.

In order for the air in the acoustic duct 37 to oscillate correctly, the air flow must be laminar and not turbulent. If the flow becomes too turbulent, sound output from the acoustic duct 37 will be reduced, along with the diaphragm damping characteristics. This is commonly known as port compression and becomes an issue at higher sound pressure levels as a greater volume of air is required to flow through the acoustic duct 37.

Due to this, the diameter of the acoustic duct 37 may be sized, and/or a length of the acoustic duct increased to maintain laminar air flow and a similar tuning frequency. Alternatively, or in addition to adjusting the diameter and length of the acoustic duct 37, the volume of the air cavity behind the diaphragm 20 may also be increased.

Figure 4:
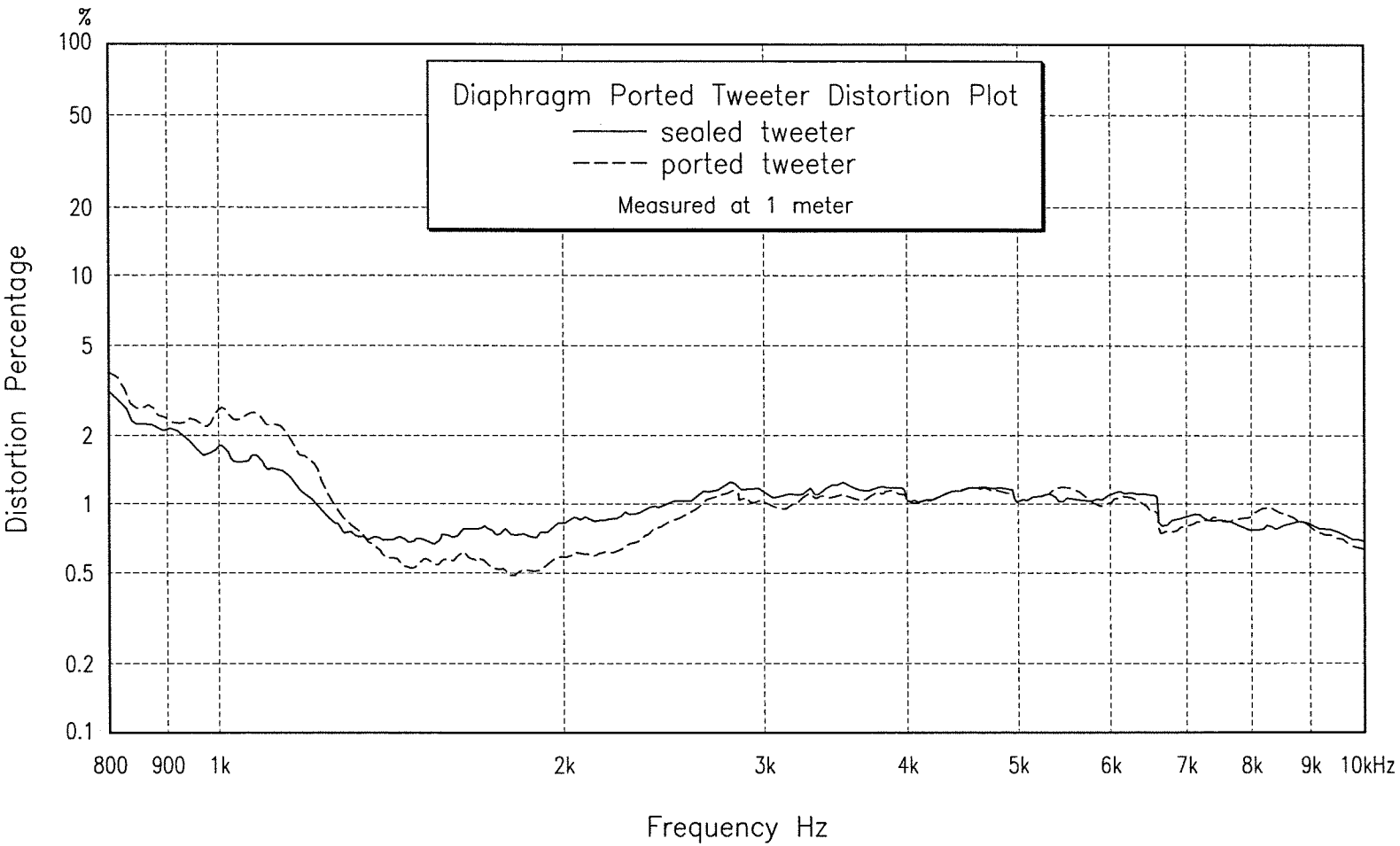
FIG. 4 is a comparative distortion response diagram of the diaphragm ported tweeter of FIG. 1.
Figure 5:
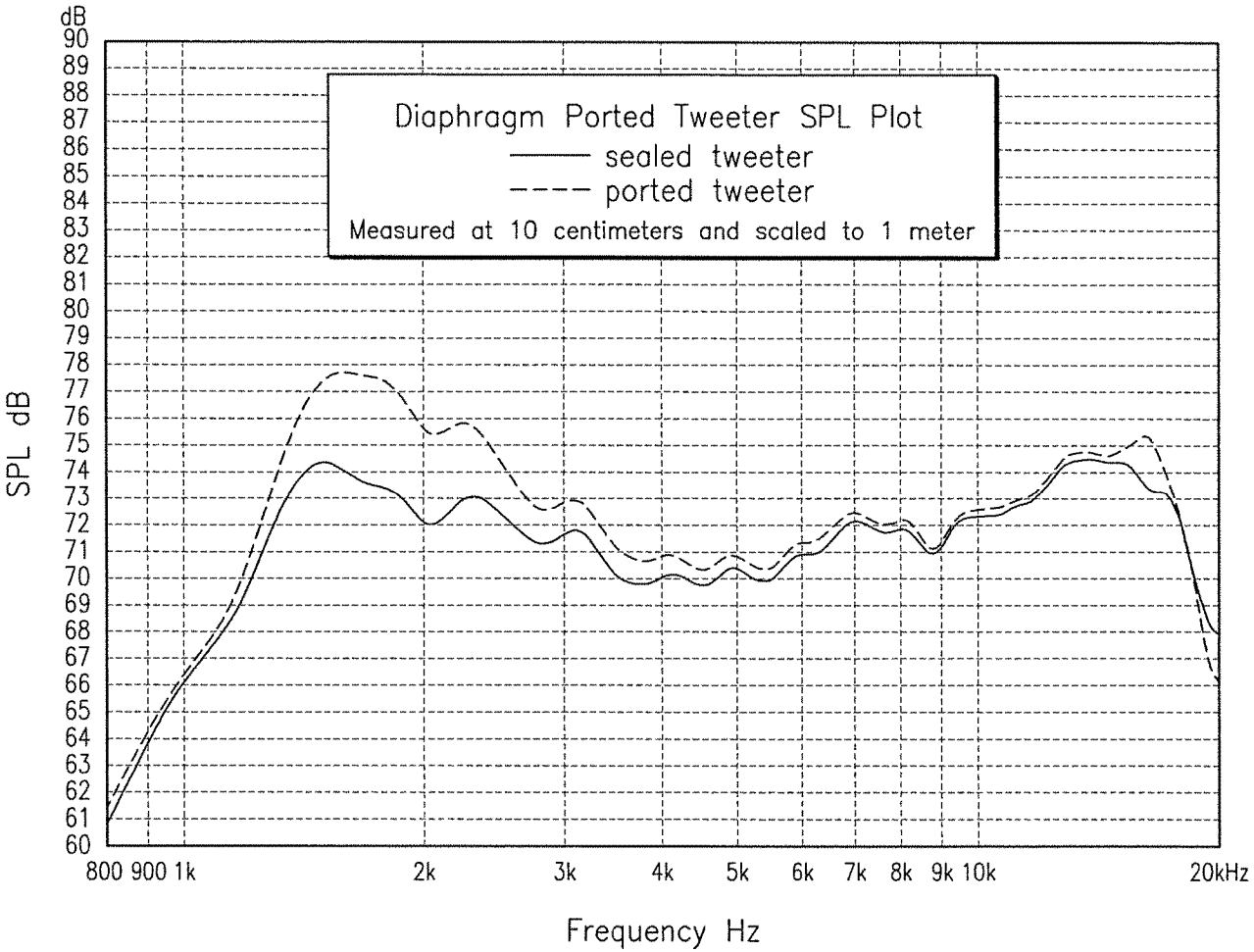
FIG. 5 is a comparative Sound Pressure Level (SPL) response diagram of the diaphragm ported tweeter of FIG. 1.

As evidenced by the test results shown in FIGS. 4 and 5, the tweeter 10 described above (identified as the "ported tweeter" in the charts) achieves significantly better sound quality than other non-ported tweeters having identical shapes, sizes and at the same power levels.

For example, in FIG. 4 the relative distortion between 1.5 k and 3.0 k Hz for the tweeter 10 is less than the sealed tweeter. Reviewing the same range of frequency in FIG. 5 between 1.5 k and 3.0 k Hz shows that the sound pressure level ("SPL") produced by the tweeter 10 is higher than that of the sealed tweeter.

To this end, the sound pressure wave produced by the oscillation of the air in the acoustic duct 37 adds to the sound pressure wave produced by the diaphragm 20, thereby increasing the total sound pressure level across a range of tuned frequencies.

The increase in air pressure on the diaphragm 20 reduces the extent of its travel which lowers the distortion when the same power is applied to the tweeter 10 as reflected in FIG. 4. As a result, the tweeter 10 is capable of more than 3 dB increase in output level across a range of tuned frequencies compared to a conventional non-ported tweeter as reflected in FIG. 5, thus requiring less than half the amplifier power to produce the same SPL as a non-ported tweeter across this range, while at the same time reducing the tweeter's distortion across these frequencies.

FIG. 6 illustrates another aspect of the tweeter 10 that includes an externally mounted support member 35*b*. As shown, the acoustic duct 37 is held by a plurality of elongated arms 41*b*, within the diaphragm aperture 16 and a perimeter of a lower open end of the acoustic duct 37 is sealed to the diaphragm 20 by a gasket 21. In this aspect, a first end of each of the elongated arms 41*b* is coupled to the acoustic duct 37, while a second end is mounted to a top 12 of the ring support 11. Alternatively, the elongated arms 41*b* could also be mounted to a waveguide, mounting frame, speaker box panel or any other edge or surface on the outside of the diaphragm 20.

Figure 7:
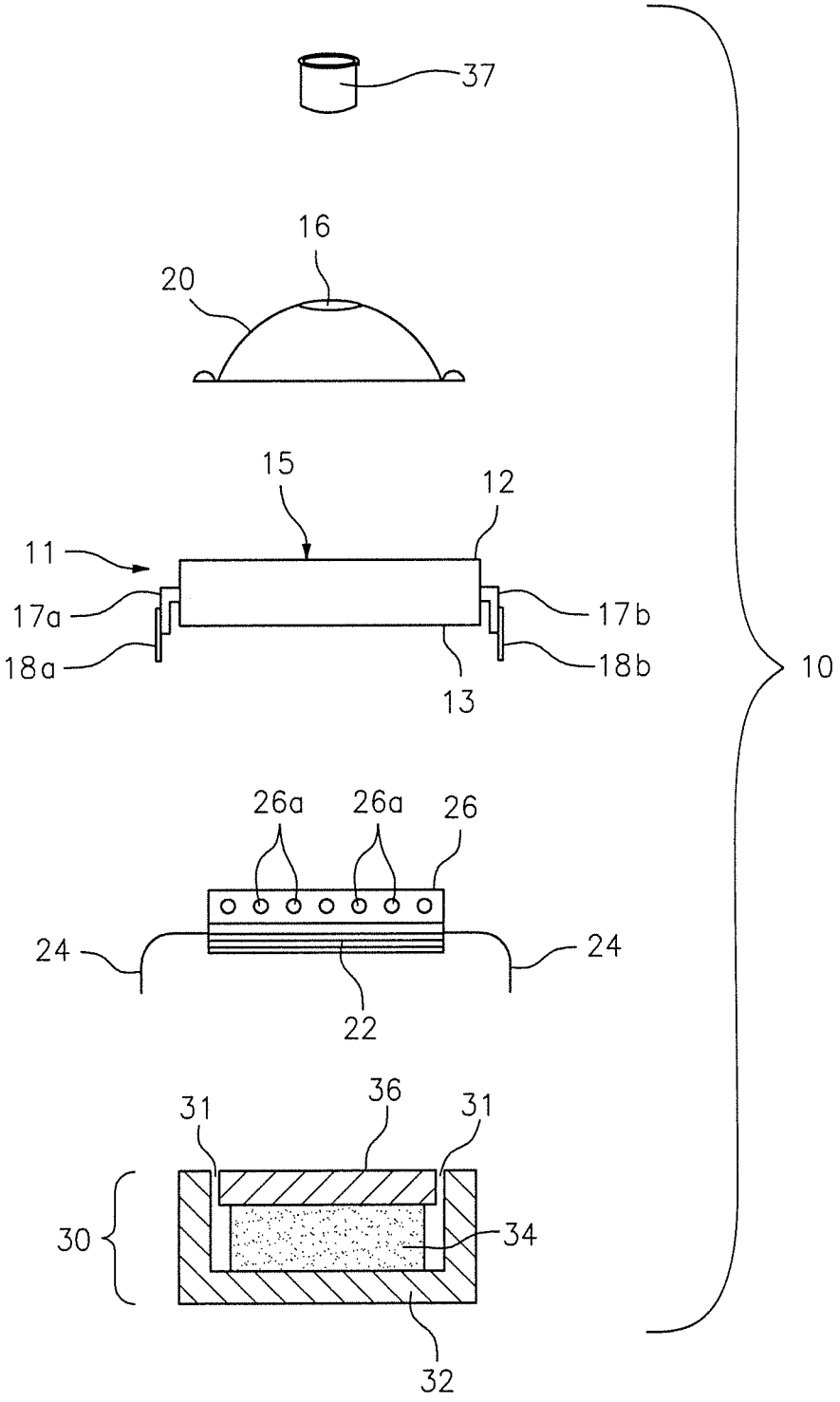
FIG. 7 is an exploded parts view of a diaphragm ported tweeter in accordance with the present disclosure with an acoustic duct supported directly by a dome-shaped diaphragm.

FIG. 7 illustrates another aspect of mounting the acoustic duct 37 directly to the diaphragm 20. For example, the acoustic duct 37 may mounted directly to the diaphragm 20 via the aperture 16. The diaphragm 20 is suitably rigid in order to minimize flexing caused by the additional mass of the acoustic duct 37 and the pressure changes from the oscillating air column within the acoustic duct 20.

Figure 8A:
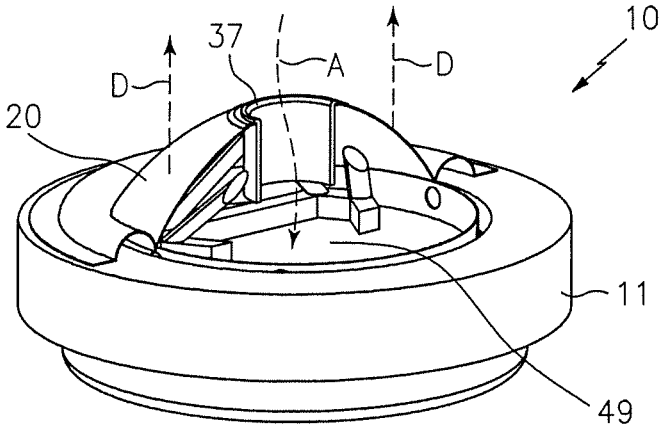
FIG. 8A is a partial cross sectional view of the diaphragm ported tweeter of FIG. 1 representing its operation below the tuning frequency.

Referring now to FIG. 8A, a partial cross sectional view of the assembled tweeter 10 in accordance with an aspect of the invention is illustrated. In particular, the air movement is represented as being well below the tuning frequency.

For example, as the diaphragm 20 moves up in the direction indicated by line D, the air within a cavity 49 that is in fluid communication with the air column within the acoustic duct 37 is acting as one unit and draws air into the cavity 49 through the acoustic duct 37 in the direction indicated by line A. When the diaphragm 20 moves down, the increased pressure within the cavity 49 forces air out through the acoustic duct 37.

At this point the diaphragm 20 and the acoustic duct 37 are out of phase, and the net result is a partial cancellation of the sound wave produced by the diaphragm 20, with an increase in the travel of the diaphragm 20 and distortion. As the frequency is increased, the inertia of the air column within the acoustic duct 37 becomes too much for it to move as one with the air in the cavity 49. At this point they start to de-couple with the air column within the duct which is being delayed from the movement of the diaphragm 20.

Figure 8B:
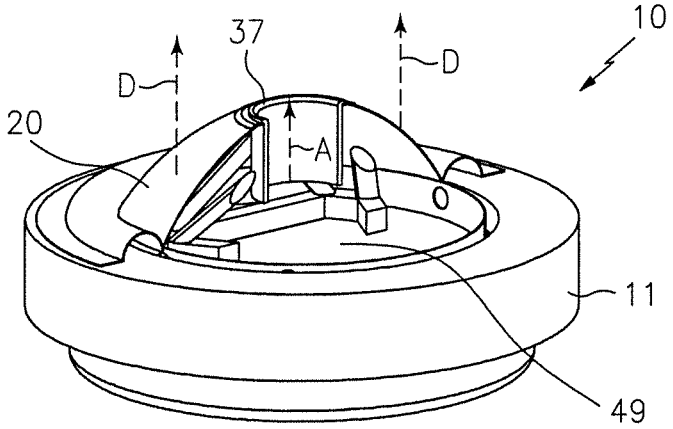
FIG. 8B is a partial cross sectional view of the diaphragm ported tweeter of FIG. 1 representing its operation at the tuning frequency.

Referring now to FIG. 8B, air movement at the tuning frequency is illustrated. For example, when ⅓ of an octave below a tuning frequency is reached, the column of air within the acoustic duct 37 begins to synchronize with the movement of the diaphragm 20 indicated by line D, increasing the total sound output. As the diaphragm 20 moves up or down at the tuning frequency, the air within the cavity 49 is either rarified or compressed. These changes in pressure causes the air column within the acoustic duct 37 to move, but due to its inertia and the elasticity of the air within the cavity 49 it is delayed by one half cycle, thus now moving in phase with the diaphragm 20 as indicated by the line A. This is the resonant frequency, with most of the sound output being emitted by the acoustic duct 37, and the travel of the diaphragm 20 minimized.

Figure 8C:
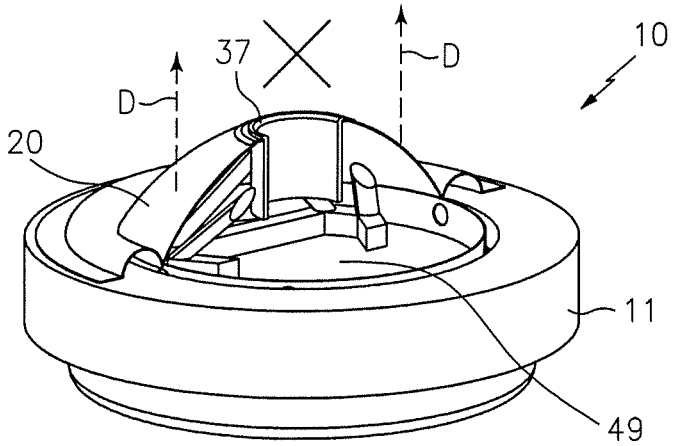
FIG. 8C is a partial cross sectional view of the diaphragm ported tweeter of FIG. 1 representing its operation above the tuning frequency.

Referring now to FIG. 8C, air movement well above the tuning frequency is illustrated. Generally, when an octave or more above the tuning frequency is reached, the inertia of the column of air within the acoustic duct 37 becomes too great to move indicated by the X, as the pressure wave from the diaphragm 20 indicated by the line D is dissipated within the air of the cavity 49. Thus the acoustic duct 37 does not contribute to any output, and the cavity 49 is effectively sealed.

As described herein, one or more elements of the tweeter 10 may be secured together utilizing any number of known attachment means such as, for example, screws, glue, compression fittings and welds, among others. Moreover, although the above aspects of the invention have been described as including separate individual elements, the inventive concepts disclosed herein are not so limiting. To this end, one of skill in the art will recognize that one or more individually identified elements may be formed together as one or more continuous elements, either through manufacturing processes, such as welding, casting, or molding, or through the use of a singular piece of material milled or machined with the aforementioned components forming identifiable sections thereof.

Many modifications and other embodiments of the present disclosure will come to the mind of one skilled in the art having the benefit of the teachings presented in the foregoing descriptions and the associated drawings. Therefore, it is understood that the present disclosure is not to be limited to the specific embodiments disclosed, and that modifications and embodiments are intended to be included within the scope of the appended claims.

That which is claimed is:

1. A diaphragm ported tweeter comprising:

a ring structure having an upper portion and a lower portion;

a dome-shaped diaphragm having a periphery secured to the upper portion of the ring structure and the dome-shaped diaphragm having a concentrically positioned aperture at an apex of the dome-shaped diaphragm; and an acoustic duct having an open first end coupled to the aperture and a second open end extending away from the aperture, wherein a sound pressure wave produced by an oscillation of air in the acoustic duct adds to the sound pressure wave produced by the dome-shaped diaphragm to increase an output sound pressure level over a range of tuned frequencies.

2. The diaphragm ported tweeter of claim 1, wherein the dome-shaped diaphragm comprises a woven fabric, thin metal or other such material.

3. The diaphragm ported tweeter of claim 1, wherein the acoustic duct is orientated perpendicular to a periphery of the ring structure.

4. The diaphragm ported tweeter of claim 1, further comprising a cavity of air formed under the dome-shaped diaphragm.

5. The diaphragm ported tweeter of claim 4, wherein the acoustic duct comprises an airway to connect ambient air to the cavity of air and is configured for a mass of air within the acoustic duct to oscillate with movement of the dome-shaped diaphragm over a range of frequencies.

6. The diaphragm ported tweeter of claim 5, further comprising a magnetic assembly secured to the lower portion of the ring structure.

7. The diaphragm ported tweeter of claim 6, wherein the acoustic duct comprises a support member having a base and a plurality of elongated arms, with each elongated arm having a first end secured to the base and a second end extending upwards to an outer surface of the acoustic duct to suspend the acoustic duct.

8. The diaphragm ported tweeter of claim 7, wherein the support member is mounted to the magnetic assembly and positioned within the cavity of air under the dome-shaped diaphragm.

9. The diaphragm ported tweeter of claim 5, wherein the acoustic duct is sized and shaped to tune the cavity of air under the dome-shaped diaphragm to a desired particular frequency.

10. The diaphragm ported tweeter of claim 1, further comprising a gasket sealing a perimeter of the open first end of the acoustic duct to the dome-shaped diaphragm.

11. The diaphragm ported tweeter of claim 1, further comprising a voice coil concentrically secured within the ring structure.

12. A diaphragm ported tweeter comprising:

a ring structure having an upper portion and a lower portion;

a dome-shaped diaphragm having a periphery secured to the upper portion of the ring structure and the dome-shaped diaphragm having a concentrically positioned aperture at an apex of the dome-shaped diaphragm, wherein a cavity of air is formed under the dome-shaped diaphragm; and an acoustic duct orientated perpendicular to the periphery of the ring structure and having an open first end coupled to the aperture and a second open end extending away from the aperture, wherein a sound pressure wave produced by an oscillation of air in the acoustic duct adds to the sound pressure wave produced by the dome-shaped diaphragm to increase an output sound pressure level over a range of tuned frequencies.

13. The diaphragm ported tweeter of claim 12, wherein the dome-shaped diaphragm comprises a woven fabric, thin metal or other such material.

14. The diaphragm ported tweeter of claim 12, wherein the acoustic duct comprises an airway to connect ambient air to the cavity of air and is configured for a mass of air within the acoustic duct to oscillate with movement of the dome-shaped diaphragm over a range of frequencies.

15. The diaphragm ported tweeter of claim 12, further comprising a magnetic assembly secured to the lower portion of the ring structure.

16. The diaphragm ported tweeter of claim 12, wherein the acoustic duct comprises a support member suspending the acoustic duct over the aperture.

17. The diaphragm ported tweeter of claim 12, wherein the acoustic duct is sized and shaped to tune the cavity of air under the dome-shaped diaphragm to a desired particular frequency.

18. The diaphragm ported tweeter of claim 12, further comprising a voice coil concentrically secured within the ring structure.

19. A method of making a diaphragm ported tweeter, the method comprising:

providing a ring structure having an upper portion and a lower portion;

securing a periphery of a dome-shaped diaphragm to the upper portion of the ring structure, wherein the dome-shaped diaphragm having a concentrically positioned aperture at an apex of the dome-shaped diaphragm; and mounting an open first end of an acoustic duct to the aperture and a second open end of the acoustic duct extending away from the aperture, wherein a sound pressure wave produced by an oscillation of air in the acoustic duct adds to the sound pressure wave produced by the dome-shaped diaphragm to increase an output sound pressure level over a range of tuned frequencies.

20. The method of claim 19, further comprising securing a voice coil and a magnetic assembly concentrically within the ring structure.

* * * * *